United States Patent [19]

O'Meara

[11] Patent Number: 4,884,703

[45] Date of Patent: Dec. 5, 1989

[54] CONTAINER AND CLOSURE ASSEMBLY

[75] Inventor: John R. O'Meara, Jamesburg, N.J.

[73] Assignee: CP Packaging Inc., Jamesburg, N.J.

[21] Appl. No.: 249,674

[22] Filed: Sep. 27, 1988

[51] Int. Cl.[4] ..... B65D 51/24

[52] U.S. Cl. ..... 215/6; 215/250; 220/278; 222/83; 222/85

[58] Field of Search ..... 222/85, 83; 215/6, 250, 215/257, 226; 220/278; 206/222

[56] References Cited

U.S. PATENT DOCUMENTS

| | | | |
|---|---|---|---|
| 1,695,190 | 12/1928 | Kane | 215/226 |
| 2,737,316 | 3/1956 | Davidson | 222/85 |
| 2,771,218 | 11/1956 | Henderson | 222/83 |
| 3,454,196 | 7/1969 | Hazard | 222/83 |
| 4,146,152 | 3/1979 | Ogawa et al. | 222/81 |
| 4,150,089 | 4/1979 | Linet | 215/6 X |
| 4,340,147 | 7/1982 | McIntosh | 215/226 |

*Primary Examiner*—Donald F. Norton

*Attorney, Agent, or Firm*—Eugene E. Renz, Jr.

[57] ABSTRACT

A multiple compartment container and closure assembly with a container having at least two adjacent compartments with end portions terminating in a common surface at one end of the container. The end is sized to accept a cap and the surface has a thin wall portion in communication with each of the compartments. A cap is sized to slidably fit on the end of the container which has puncture means being positioned in alignment with each of the thin wall portions of the container so that movement of the cap from a first position on the end to a second position causes the puncture means to puncture the respective thin wall portion with which it is aligned, to permit access to the contents of the adjacent compartments. A surface of interference on the one end of the container is positioned a predetermined distance from the thin wall portions, and a surface of resistance on the inside of said cap 15 positioned to engage the surface of interference to locate the cap on the end portion at the first position to prevent inadvertent movement of the cap to the second position.

14 Claims, 1 Drawing Sheet

CONTAINER AND CLOSURE ASSEMBLY

FIELD OF THE INVENTION

This invention relates to double compartment closure and tube assemblies in which materials are stored in at least two separate compartments until the compartments are opened for use, at which time the components are often times mixed together. The device is particularly suitable for medical applications where two or more reagents are to be precisely monitored during use.

BACKGROUND OF THE INVENTION

There are a variety of applications in which two ingredients are kept separate from one another in a single container, such as a dual compartment container, so that at the appropriate time the two components can be used for their intended purpose. Prepackaging of specific doses or quantities is greatly facilitated by the use of multiple compartment containers and closures.

By the use of containers having precisely measure quantities of components, it is possible to develop packaging which is "user friendly" in the sense that mistakes made by the user are virtually avoided. For example, in pregnancy test kits which are used in the privacy of the home, it is necessary to precisely monitor a specific quantity of drops of two reagents into the urine specimen. Avoiding the necessity of counting drops eliminates a major source of mistake, and substantially increases the reliability of the test kit. Thus, if the precise quantities of both reagents are in a dual compartment container, and if access to that precisely monitored amount is extremely reliable, a greater degree of confidence in the test can be expected.

Another situation where precise monitoring and avoidance of mistakes is important is the mixing of small quantities of epoxy glue and other similar materials. Telephone lineman working on telephone wire high above the ground no longer splice wires. The present technology calls for a quick setting application of epoxy glue to bond the wires together. If it would be possible to avoid requiring the lineman to count drops of initiator to cause the epoxy to set, greater accuracy, greater strength and greater safety would be achieved.

In these situations and in others, considerable interest is now being shown in cap and container assemblies which cannot be opened by happenstance but which require a specific and positive step to be taken in order to have access to the contents. This is particularly true when the precise amount of the contents is important. It is also particularly significant when protection of either the user or the ingredients is of prime importance. In the case of reagents for medical purposes, a sterile environment is absolutely essential. In the case of other applications, such as the epoxy resin application described above, inadvertent contact by the ingredients on the skin is undesirable and should be avoided.

In actual practice, the assurance that the tube has not been opened prematurely is sometimes as important as the need to prevent undesirable tampering, so as to be assured of the integrity of the material. This is true because the contents, while valuable, are not dangerous. It is very important to know whether or not the contents have been contaminated or, perhaps, partially spilled. Particularly when single unit doses are provided in compartments of a container, it is important to know that the full quantity of medicine which has been prescribed has also been delivered to the patient.

Prior art devices have not yet produced a practical multiple compartment container and closure assembly which is capable of being transported safely without concern for inadvertent opening of the containers while at the same time provides for a quick and uncomplicated opening of the two components at the same time. One such design which has been relatively unsuccessful includes the one piece molding of a container and closure so that the cap can be torn from the container, by twisting or pulling. This has been unacceptable as a method because the separation of the container from the closure is done in a way that pressure is applied to the container. This positive pressure often times results in spurts of contents escaping from container during the opening process, rather than when the contents are to be used. These prior art designs also are incapable of re-closing the container once the closure has been separated from the containers. To remedy this, plug type members have been proposed for use with the other end of the closure, so that it can be inverted and forced down on the end of the tube after it has been opened. This, of course, exposes the torn off ends of the cap and any portion of the contents which may have spattered onto the torn ends. Additionally, it employs a portion of the cap which has been exposed to the environment as the secondary closure mechanism.

Container and closure assemblies which are designed for single compartment containers can be fabricated in round containers, so that the end can be threaded and selectively removed and attached. An example of this type of closure, with a built in piercing device, is shown in U.S. Pat. Nos. 4,340,147 and 3,454,196. Neither design is suitable for use with a plurality of compartments, unless each of the compartments is to be opened with its own cap assemble. U.S. Pat. Nos. 4,146,152 and 1,695,190 describe closures for single compartment containers which are even less suitable for adaptation to multiple compartment container and closure assemblies.

Accordingly, it is quite important that a new and improved container and closure assembly be developed which would have a reliability of use and would protect both the contents and the user from unwanted contamination. It would be of particular value if the device could be provided which would permit continued use of the container once access to the contents has been made.

SUMMARY OF THE INVENTION

It has now been discovered that the above and other objects of the present invention may be accomplished in the following manner. Specifically, a multiple compartment container and closure assembly has been discovered which comprises the following components. A container is provided having at least two adjacent compartments with end portions terminating in a common surface at one end of the container. That end is sized to accept a cap. The surface has a thin wall portion for each of the compartments, that thin wall portion being in direct communication with its respective compartment so that when the thin wall is ruptured or broken, access to the contents of the compartment can be made.

Also provided is a cap which is sized to slidably fit on the end of the container. The cap has a plurality of puncture means, each of which is positioned in alignment with one of the thin wall portions of the container so that movement of the cap from a first position on the end of the container to a second position causes each puncture means to puncture the respective thin wall portion with which it has been aligned. This permits access to the contents of the various compartments.

The container is also provided with a surface of interference on that end of the container. This surface of interference is positioned a predetermined distance from the thin wall portions. In cooperation therewith, a surface of resistance is provided on the inside of said cap so that engagement of the surface of interference and surface of resistance positions the cap at the first position, whereby inadvertent movement of the cap to the second position is prevented. The surface of interference and the resistance surface cooperatively resist movement of the cap to the second position of puncturing. A force is necessary to overcome this resistance. The amount of the force is sufficient to prevent inadvertent movement of the cap to that second position on the compartment end.

Typically, the surface of interference and the resistance surface may comprise a shoulder on the container which interacts with the end of the closure. Alternatively, a plurality of ridges may be employed, with one ridge being located on either the container or the closure and a pair of ridges located on the other component. The pair of ridges may define a groove. Alternatively, the pair of ridges may be replaced by a groove into which the ridge fits.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 1:
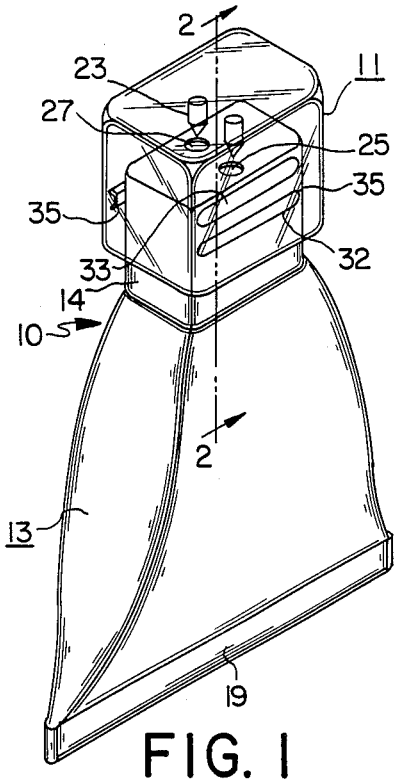
FIG. 1 is a perspective view of a container and its associated closure member showing a preferred embodiment of the present invention.

As shown in the drawings, the assembly 10 has a cap 11 and a container 13 which are combined so that the cap 11 engages one end 14 of the container 13. The container 13 is filled, typically with a small quantity of a product, after the cap and container assembly has been manufactured and sterilized, if necessary. The container includes a first compartment 15 and a second compartment 17, both of which contain the product for which the assembly is intended. The contents are placed in the two compartments 15 and 17 and the other end, 19, away from the closure 11, is then sealed by crimping, heat sealing or other conventional method for permanently closing that end of a container. In one embodiment, the cap 11 is clear or transparent, so that the user can see if the package has been punctured.

The closure 11 includes a pair of puncture means 21 and 23, which are shown as sharp pointed extensions of the inside of the closure cap 11 and which are suitable for piercing thin portions of the material from which the particular containers are manufactured, such as plastics and the like.

The end 14 of the container 13 terminates in a common surface 24 which contains a thin wall portion 25 in communication with first compartment 15 and a thin wall portion 27 in communication with second compartment 17. The two compartments 15 and 17 are separated by a divider wall 29 so that the contents of the compartments 15 and 17 are not comingled until the appropriate time.

Figure 2:
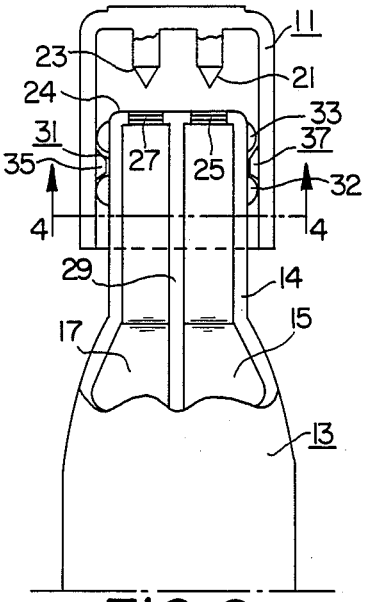
FIG. 2 is an enlarged fragmentary sectional elevational view taken along lines 2—2 of FIG. 1.

As is shown in FIG. 2, the piercing members 21 and 23 become aligned with the thin wall portions 25 and 27 when the closure cap 11 is slidably fit on the end 14 of container 13. As shown in FIG. 2, this first position of the cap 11 on the end 14 provides for a closure which protects the thin wall portions 25 and 27 from contamination and damage.

Figure 3:
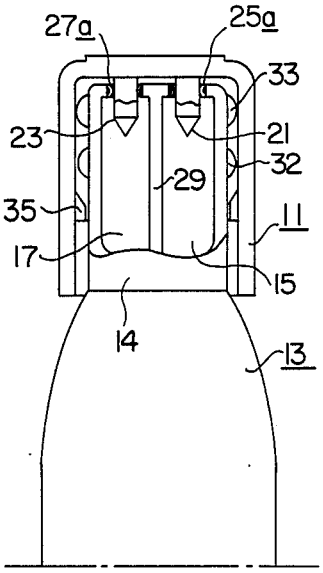
FIG. 3 is a view similar to FIG. 2 but showing the closure member in a piercing mode.
Figure 4:
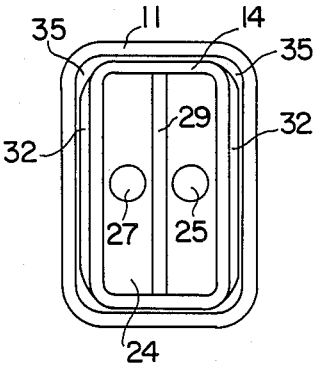
FIG. 4 is a sectional view taken along the lines 4—4 of FIG. 2.

When the cap 11 is moved to a second position, as shown in FIG. 3, the puncture means 21 and 23 puncture the respective thin wall portions 25 and 27 with which they are aligned. This permits access to the contents of the adjacent compartments 15 and 17. In a preferred embodiment, the puncture means 21 or 23 is of smaller diameter than the thin wall 25 or 27. Upon movement of the cap 11 axially down on the tube end 14, the puncture means 23 punctures the thin wall 27, causing portions of the thin wall to curl as shown at **27*a* in FIG. 3. Likewise, piercing using puncture member 21 causes thin wall 25 to produce curled edges 25*a*. The size and shape of the puncture member 25 is such that it will not go to the edge of thin wall 27, thereby causing the thin wall 27*a* to peel back but not causing it to be sheared from its position and fall into compartment 17**.

In order to locate the cap 11 on the end 14 of the container 13, a surface of interference 31 is provided on the end 14 of the container 13. The surface of interference 31 is located a predetermined distance from the thin wall portions 25 and 27. The cap 11 has a surface of resistance 37 which allows the cap 11 to be positioned to engage the surface of interference 31 and locate the cap 11 on the end 14 in a first position to prevent an advertent movement of the cap 11 to the second position. In FIG. 2, the surface of interference 31 is in the form of a groove or spacing located between lower ridge 32 and upper ridge 33. The surface of resistance 37 is located on a ridge 35 on the interior portion of the cap 11. When the cap 11 is inserted on the end 14 of the container 13, the ridge 35 snaps into place between the lower ridge 32 and upper ridge 33 of the end 14. The surface of resistance 37 located on ridge 35 is pressed against the surface of interference 31, which in this embodiment is a groove between the ridges 32 and 33. With the cap 11 firmly locked in place on the end 14 of the container 13 in the first position, as shown in FIG. 2. The thin wall portions 25 and 27 are protected from contamination and from damage.

Upon the application of adequate force, the surface of resistance 37 on ridge 35 slides over the lower ridge 32 and leaves the surface of interference 31 so that the puncture members 21 and 23 puncture thin walls 25 and 27 respectively, and access is now made to the adjoining compartments 15 and 17. The operation of the device shown in FIGS. 2 and 3 is simple, and yet it is extremely effective in protecting the contents of the container until a decision is made to access the contents for use by a consumer. Upon application of adequate force, the thin wall portions 25 and 27 are punctured. The peel back feature of the thin wall 27, shown as 27*a* in FIG. 3, which is caused do to the relationship between the size of the piercing member 23 and the area of the thin wall portion 27, is out of the way and does not present a danger to the consumer when the contents are removed. In addition, there are no pieces of the thin wall portion inadvertently mixed with the contents of the containers 15 and 17. The thin wall portions 25 and 27 can be made from plastic, during the molding operation. Alternatively, they can be made from thin portions of metal foil if the contents of the container are such that plastic is not an effective containment material.

Figure 5:
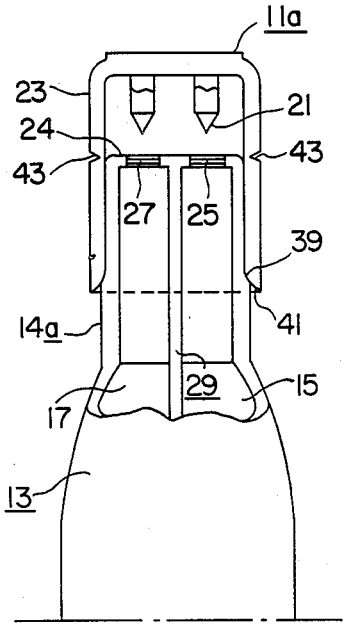
FIG. 5 is a view similar to FIG. 2 but showing a modified container and closure.
Figure 6:
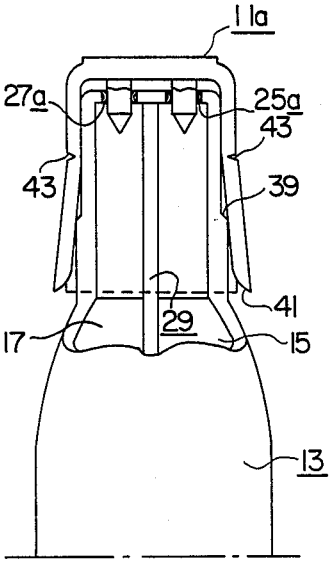
FIG. 6 is a view similar to FIG. 3, showing the modified closure member in its piercing mode.
Figure 7:
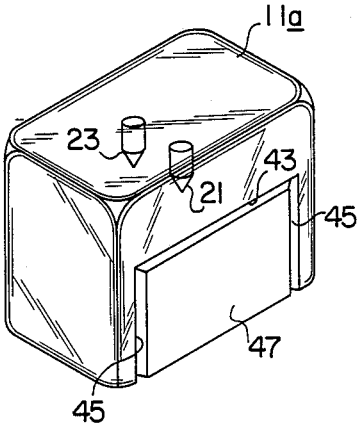
FIG. 7 is an enlarged perspective view of the modified closure shown in FIGS. 5 and 6.

In FIGS. 5, 6 and 7, a second preferred embodiment is shown in which the cap 11*a* and container 13 function as an assembly in the same manner as previously described to protect the contents of the container. As shown in FIG. 5, the cap 11*a* is snugly fit on the end 14*a* of container 13. A shoulder 39 prevents movement of the end 41 of the cap 11*a* beyond the first position which has previously been defined as a position wherein the cap 11*a* protects the thin wall portion 25 and 27 of common surface 24 of the end 14*a* of the container. The shoulder 39 of end 14*a* and the end 41 of cap 11*a* prevent inadvertent movement of the cap 11*a* to a position where the puncture means 21 or 23 might impact on thin walls 25 and 27 respectively. The force required to overcome the cooperative resistance between the surface of interference 39 and the surface of resistance 41 is sufficient to prevent inadvertent access to the contents of the container 13.

In FIG. 6, the cap 11*a* has been moved with sufficient force to overcome the resistance caused by the junction of shoulder 39 and end 41. In some instances, the material from which the cap 11*a* is manufactured, such as some grades of plastics, will have sufficient elasticity to permit the cap to slide over the shoulder 39. In cases where the cap is made of a more rigid or less elastic material, or when the resistance force caused by the junction of shoulder 39 and end 41 is intentionally designed to be high, the feature shown here may be employed. Specifically, a groove or cut 43 is provided in the wall of the cap 11*a* along with a pair of axially extending cuts 45 or which can be seen in FIG. 7. First, the cap 11*a* is moved toward the container 13, overcoming the force of resistance caused by the shoulder 39 and end 41. Once the end 41 has been moved beyond the shoulder 39, the force causes the movement of the cap 11*a* to bring the puncture means 21 and 23 to enter through the thin walls 25 and 27. This force is sufficient to cause the wall of the tube 11*a* to bend at the groove 43 so that portions 47 of the tube 11*a* separate along lines or cuts 45 to flare out. The portion of the cap 11*a* which is above the groove 43 maintains a snug fit and, with appropriate tolerances, is sufficient to keep the cap and container assembly functioning after the thin walls 25 and 27 have been punctured. As shown FIG. 7, the cuts 43 and 45 do not interfere with the operation of the container and closure assembly prior to the puncturing of the thin walls 25 and 27. Once the thin walls 25 and 27 have been punctured, access to the contents is readily obtained.

The operation of the closure and container assembly of this invention is relatively simple. At the appropriate time when the contents are to be removed, the cap 11 or 11*a* is pushed from the first position where the cap functions to protect the end 14 of the container 13 to the second position which causes the puncturing members 21 and 23 to puncture the thin walls and allow for access to the specific materials contained in each of the adjacent compartments 15, 17 and the like. When the device is used as a pregnancy testing kit, for example, it is a simple matter to overcome the force of resistance to cause the thin walls to be punctured. The cap 11 or 11*a* is then removed and the contents are poured into the urine specimen and the results of the test are reliably obtained because no measurement has been required by the person performing the test. Similarly, if other materials are contained in the container, equally simple and effective access can be had. It should be readily apparent that two compartments 15 and 17 have been illustrated to describe the preferred embodiment. Nevertheless, more than two compartments can easily be accommodated according to the principals of the present invention. Similarly, the compartments do not need to be identical in size. This invention is admirably suited to situations where a precise ratio of one ingredient to the other is required, so that a first compartment twice as large as the second compartment could easily be constructed.

While particular embodiments of the present invention have been illustrated and described herein, it is not intended to limit the invention and changes and modifications may be made therein within the scope of the following claims:

What is claimed is:

1. A multiple compartment container and closure assembly, comprising:

a container having at least two adjacent compartments with end portions terminating in a common surface at one end of said container, said end being sized to accept a cap and said surface having a thin wall portion in communication with each of said compartments;

a cap sized to slidably fit on said end of said container and having puncture means being positioned in alignment with each of said thin wall portions of said container so that movement of said cap from a first position on said end to a second position causes said puncture means to puncture the respective thin wall portion with which it is aligned, to permit access to the contents of said adjacent compartments; and a surface of interference on said one end of said container positioned a predetermined distance from said thin wall portions, and a surface of resistance on the inside of said cap positioned to engage said surface of interference to locate said cap on said end portion at said first position to prevent inadvertent movement of said cap to said second position.

2. The assembly of claim 1, wherein said surface of interference and said resistance surface comprise a plurality of ridges such that two ridges are provided on either said cap or said end of said container and one ridge is provided on the other of said cap or said end of said container, whereby said one ridge fits between said two ridges to locate said cap on said end portion in said first position.

3. The assembly of claim 1, wherein said surface of interference comprises a shoulder on said container end and said resistance surface comprises the end of the sidewall of said cap.

4. The assembly of claim 3, wherein said cap is made from a material capable of expanding under force to permit movement of said cap to said second position on said container and upon application of sufficient force.

5. The assembly of claim 1, wherein said end portion of said container and said cap are mutually sized to provide a snug fit therebetween.

6. The assembly of claim 1, wherein said puncture means comprise a sharp pointed means aligned above each thin wall portion for tearing said thin wall along a plurality of lines radially extending from the point of contact between said sharp pointed means and said thin wall.

7. The assembly of claim 6, wherein said puncture means is sized to puncture said thin wall without contacting the edge of said thin wall.

8. A double compartment container and closure assembly, comprising:

a container having two adjacent compartments with end portions terminating in a common surface at one end of said container, said end being sized to accept a cap and said surface having a pair of thin wall portion in communication with each of said compartments;

a cap sized to slidably fit on said end of said container and having puncture means being positioned in alignment with each of said thin wall portions of said container so that movement of said cap from a first position on said end to a second position causes said puncture means to puncture the respective thin wall portion with which it is aligned, to permit access to the contents of said adjacent compartments; and a surface of interference on said one end of said container positioned a predetermined distance from said thin wall portions, and a surface of resistance on the inside of said cap positioned to engage said surface of interference to locate said cap on said end portion at said first position to prevent inadvertent movement of said cap to said second position.

9. The assembly of claim 8, wherein said surface of interference and said resistance surface comprise a plurality of ridges such that two ridges are provided on either said cap or said end of said container and one ridge is provided on the other of said cap or said end of said container, whereby said one ridge fits between said two ridges to locate said cap on said end portion in said first position.

10. The assembly of claim 8, wherein said surface of interference comprises a shoulder on said container end and said resistance surface comprises the end of the sidewall of said cap.

11. The assembly of claim 10, wherein said cap is made from a material capable of expanding under force to permit movement of said cap to said second position on said container and upon application of sufficient force.

12. The assembly of claim 8, wherein said end portion of said container and said cap are mutually sized to provide as nug fit therebetween.

13. The assembly of claim 8, wherein said puncture means comprise a sharp pointed means aligned above each thin wall portion for tearing said thin wall along a plurality of lines radially extending from the point of contact between said sharp pointed means and said thin wall.

14. The assembly of claim 13, wherein said puncture means is sized to puncture said thin wall without contacting the edge of said thin wall.

* * * * *